United States Patent [19]

Andersen

[11] 4,116,413

[45] Sep. 26, 1978

[54] COLLAPSIBLE BOOK STAND

[76] Inventor: Peter A. Andersen, Foxfire Apts. R4, Greenville, S.C. 29611

[21] Appl. No.: 746,415

[22] Filed: Dec. 1, 1976

[51] Int. Cl.[2] ..... A47B 97/04

[52] U.S. Cl. ..... 248/451; 248/455; 248/460

[58] Field of Search ..... 248/242, 451, 452, 453, 248/455, 460, 461; 403/61, 85

[56] References Cited

U.S. PATENT DOCUMENTS

| | | | |
|---|---|---|---|
| 1,249,340 | 12/1917 | Cromwell | 248/242 X |
| 1,864,807 | 6/1932 | Dahlgren | 248/453 |
| 1,869,278 | 7/1932 | Ramelli | 248/455 |

FOREIGN PATENT DOCUMENTS

| | | | |
|---|---|---|---|
| 176,863 | 10/1906 | Fed. Rep. of Germany | 248/455 |
| 330,700 | 12/1919 | Fed. Rep. of Germany | 248/455 |
| 1,208,271 | 10/1970 | United Kingdom | 248/455 |

*Primary Examiner*—William H. Schultz

*Attorney, Agent, or Firm*—Bailey, Dority & Flint

[57] ABSTRACT

A collapsible stand for supporting a book in an inclined readable position. The stand includes a base member having rearwardly extending side walls provided with slots therein. A planar book rest extends upwardly from the base member. A flexible bracket is connected between the base member and the book rest for supporting the book rest at a desired reading angle. The flexible bracket also permits the book rest to be folded down within the base member into a compact package for carrying.

4 Claims, 3 Drawing Figures

COLLAPSIBLE BOOK STAND

BACKGROUND OF THE INVENTION

The present invention relates to a collapsible book stand, and more particularly to a book stand which is adjustable to support various size books at various reading angles and can be collapsed into a compact package.

Frequently in studying, a student or reader props his books in an open position against objects and holds it in such open position by placing another object thereagainst. However, oftentimes when it is desired to follow the text in a book while taking notes, it is not convenient or practical to prop a book up at the desired reading angle.

The book stand constructed in accordance with the present invention overcomes this problem in that it can be readily carried by the student or user in the folded condition which is substantially the size of an average text book. When it is desired to use the book stand it is merely unfolded so as to support the book at the desired reading angle.

The collapsible book stand constructed in accordance with the present invention includes a base member having a front and a pair of spaced rearwardly extending side members. Elongated slots are provided in the rearwardly extending side members. Extending upwardly from the base member is a book rest.

Elongated slots are carried on flanges provided on the book rest. A flexible bracket is releasably connected between the elongated slots provided on the book rest and the elongated slots provided in the horizontally extending sides of the base member. The flexible bracket can be adjusted so as to vary its length and angular shape in order to support the book rest at a desired reading angle while permitting the stand to be collapsed into a compact package when not in use.

Accordingly, it is an important object of the present invention to provide a book stand that can be readily collapsed into a compact package.

Still another important object of the present invention is to provide a book stand that can be opened up so as to support various size books at various reading angles.

Still another important object of the present invention is to provide a relatively inexpensive and simple book stand that can be readily carried and transported by a user.

These and other objects and advantages of the invention will become apparent upon reference to the following specification, attendant claims and drawing.

DESCRIPTION OF A PREFERRED EMBODIMENT

Figure 1:
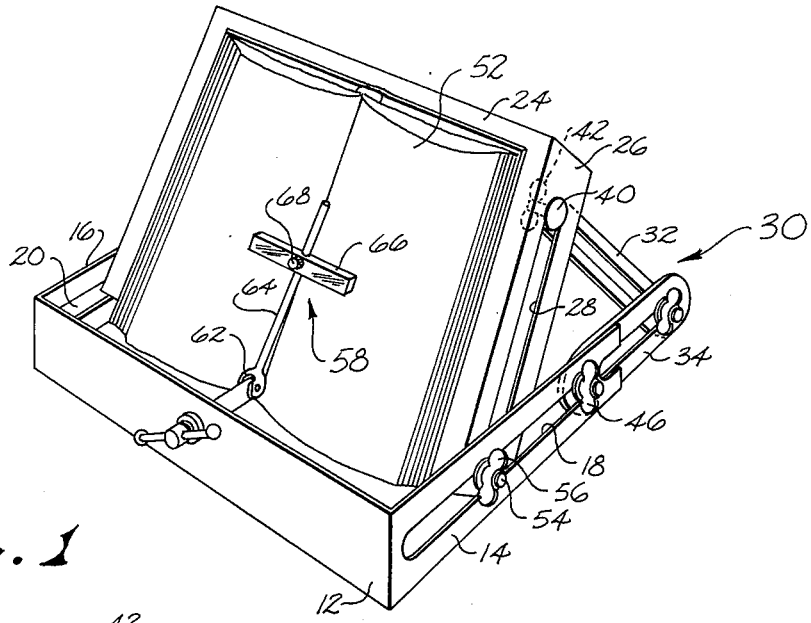
FIG. 1 is a perspective view illustrating a book rest constructed in accordance with the present invention.

Referring in more detail to the drawing, there is illustrated a collapsible book rest which includes a base member which has a front portion 12 with a pair of rearwardly extending side members 14 and 16. Elongated slots 18 and 20 are provided in the rearwardly extending side members 14 and 20, respectively. Another U-shaped slot is provided in the remote end of the side members 14 and 16 for accommodating a bolt and wing-nut when the book stand is in the collapsed position.

A planar book rest 24 is carried within the base member for supporting a book. Extending rearwardly on opposite sides of the planar book rest 24 are flanges 26. An elongated slot 28 is provided in these base flanges 26.

A flexible bracket, generally designated by the reference character 30 is provided for supporting the book rest 24 above the base member 12. The flexible bracket 30 includes an upper linkage 32 and a lower linkage 34. Each of these linkages 32 and 34 have elongated slots 36 and 38, respectively, provided therein so that the overall length of the bracket 30 may be adjusted and the angular shape of the bracket 30 may be adjusted.

The upper end of the bracket 30 is connected to the rearwardly extending flange 26 of the book rest by means of a bolt 40 and a wing-nut 42. A similar bolt 44 and wing-nut 46 is provided for connecting the lower end of the bracket 30 into the slot 18 provided in the side wall 14. In order to vary the angular shape of the bracket 30 another bolt 48 and wing-nut 50 is used for connecting the inner ends of the linkage arms 32 and 34 together. While in the drawing only one bracket is seen, it is to be understood that normally two brackets are used on opposite sides of the base member for securely holding the book rest 24.

Figure 2:
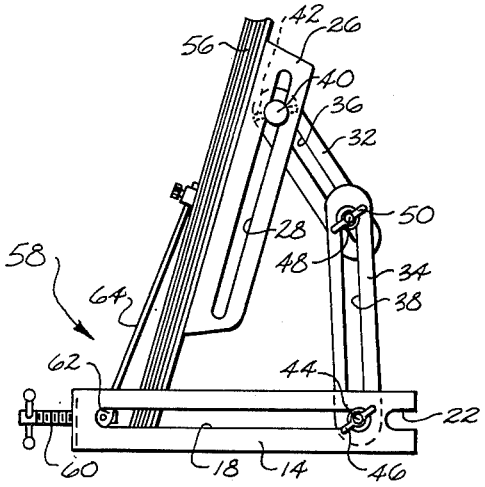
FIG. 2 is a side elevational view of the book rest shown in FIG. 1.

When it is desired to open up the book stand for use, the wing-nuts are merely loosened and the bracket 30 is extended to a desired shape such as illustrated in FIGS. 1 and 2 for holding a book 52 at a desired angle.

A bolt 54 and wing-nut 56 can be used for attaching the lower end of the rearwardly extending flange 26 to the side wall 14, such as illustrated in FIG. 1 to provide a more sturdy book stand. However, this bolt and wing-nut is not utilized when it is desired to raise the back rest 24 up above the base member 14 so as to support a taller book 56 in the open position as illustrated in FIG. 2.

Figure 3:
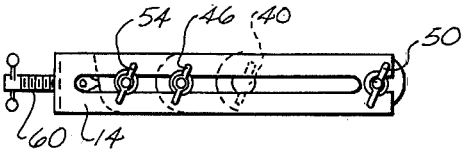
FIG. 3 is a side elevational view illustrating the book rest of FIGS. 1 and 2 in a collapsed position.

When it is desired to collapse the book stand, the wing-nuts are merely loosened and it is folded into the compact package such as illustrated in FIG. 3, with the back rest 24 positioned within the side walls 14 and 16 of the base member 12.

A page holder generally designated by the reference character 58 is provided for holding the pages of the books 52 and 56 in an open position. This page holder includes a horizontally threaded shaft 60 which extends through a threaded hole provided in the front wall 12 of the base member. On the inner end of the shaft 60 is a pivot joint 62 to which a linkage arm 64 is pivotally connected. Provided on the upper end of the linkage arm 64 is a crossbar 66 which has a hole provided therein through which the linkage arm 64 extends. An adjustable thumb bolt 68 is threaded through the crossbar 66 for locking the crossbar onto the linkage arm 64. By loosening the thumb bolt 68 the crossbar 66 can be adjusted to the desired height for properly holding the pages of the book open. The horizontally threaded member 60 can be rotated in and out so as to properly position the page supporting member 58 relative to the book.

While a preferred embodiment of the invention has been described using specific terms, such description is for illustrative purposes only, and it is to be understood that changes and variations may be made without departing from the spirit or scope of the following claims.

What is claimed is:

1. A collapsible stand for supporting a book in an inclined readable position comprising:

(a) a base portion into which a book can be positioned, said base portion having a pair of rearwardly extending sides;

(b) a substantially planar book rest;

(c) a bracket supporting said book rest;

(d) means for pivotally connecting a lower end of said bracket to one of said rearwardly extending sides;

(e) means for pivotally connecting an upper end of said bracket to said book rest;

(f) said bracket being extendable so as to vary the overall length of said bracket:

(g) an elongated slot provided in at least one of said rearwardly extending sides; and (h) said means for pivotally connecting a lower end of said bracket to one of said rearwardly extending sides includes:

(i) a bolt extending through a lower end of said bracket and said slot provided in said one side and (ii) a nut carried on said bolt for securing said bracket to said side and for permitting said lower end of said bracket to be adjustable in a longitudinal direction along said side;

whereby the angle and height that said planar book rest is held relative to said base portion is adjustable for supporting a book at a desired reading angle and for accommodating different size books.

2. The collapsible stand as set forth in claim 1 wherein said bracket includes, a pair of extensions; each of said extensions having a slot provided therein, and means for releasably and pivotally connecting said extension together so as to adjust the overall length of said bracket and the shape of said bracket.

3. The collapsible stand as set forth in claim 1 further comprising:

a page holder carried by said base member and extending upwardly adjacent said book rest for holding the pages of a book in an opened position.

4. A collapsible stand for supporting a book in an inclined readable position comprising:

a base member having a front and a pair of spaced rearwardly extending side members, an elongated slot provided in at least one of said side members:

a vertically extending book rest;

an elongated slotted member carried by said book rest; and a flexible bracket including a pair of linkage arms adjustably connected to one another to vary the overall length and shape of said bracket extending between said base member and book rest for supporting said book rest;

means for adjustably attaching a lower end of one of said arms through said slot in said one side member; and means for adjustably attaching an upper end of said other arm through said elongated slot in said elongated slotted member carried by said book rest;

whereby said book rest can be positioned to support a book at a desired reading angle or folded into said base member when not in use.

* * * * *